United States Patent [19]

Wolff

[11] 4,099,183

[45] Jul. 4, 1978

[54] SELF-DESTROYING LOCATION MARKING MEANS

[75] Inventor: Hanns H. Wolff, Orlando, Fla.

[73] Assignee: The United States of America as represented by the Secretary of the Navy, Washington, D.C.

[21] Appl. No.: 854,809

[22] Filed: Aug. 26, 1969

[51] Int. Cl.[2] ..... H01Q 15/18

[52] U.S. Cl. ..... 343/18 B; 343/18 C

[58] Field of Search ..... 343/18 B, 18 C

[56] References Cited

U.S. PATENT DOCUMENTS

| | | | |
|---|---|---|---|
| 2,519,825 | 8/1950 | De Ment | 343/18 B UX |
| 3,725,927 | 4/1973 | Fiedler | 343/18 B X |
| 3,952,307 | 4/1976 | Nagler | 343/18 B |

*Primary Examiner*—T.H. Tubbesing

*Attorney, Agent, or Firm*—J. C. Warfield; J. W. Pease; J. F. Miller

[57] ABSTRACT

Self-destroying location marking means having a predetermined lifespan are provided for enabling orientation in strange and/or featureless territory.

8 Claims, 5 Drawing Figures

SELF-DESTROYING LOCATION MARKING MEANS

STATEMENT OF GOVERNMENT INTEREST

The invention described herein may be manufactured and used by or for the Government of the Unites States of America for governmental purposes without the payment of any royalties thereon or therefor.

BACKGROUND OF THE INVENTION

The invention is in the field of location marking or identification. In many areas the terrain is so featureless or uniform that orientation of aircraft pilots (and other travelers) by visual observation is impossible. This is a serious problem in combat situations where pilots unfamiliar with the terrain and local flying conditions must often locate a target or other destination under adverse conditions of weather and darkness. In the absence of identifiable geographic features pilots have had to resort to various expedients, for example, dead reckoning, to maintain orientation. In some situations it is feasible to airdrop radar beacons to guide friendly aircraft; however, there is a probability that such beacons will be destroyed by enemy action, or relocated by the enemy to mislead friendly forces. The invention solves this problem simply and inexpensively with self-destructive location marking means.

SUMMARY OF THE INVENTION

Objects made of various materials having various shapes and capable of reflecting signals are designed to be placed conveniently. The objects are treated with materials which destroy them or render them non-reflective after a predetermined length of time.

DESCRIPTION OF THE PREFERRED EMBODIMENT

Figure 1:
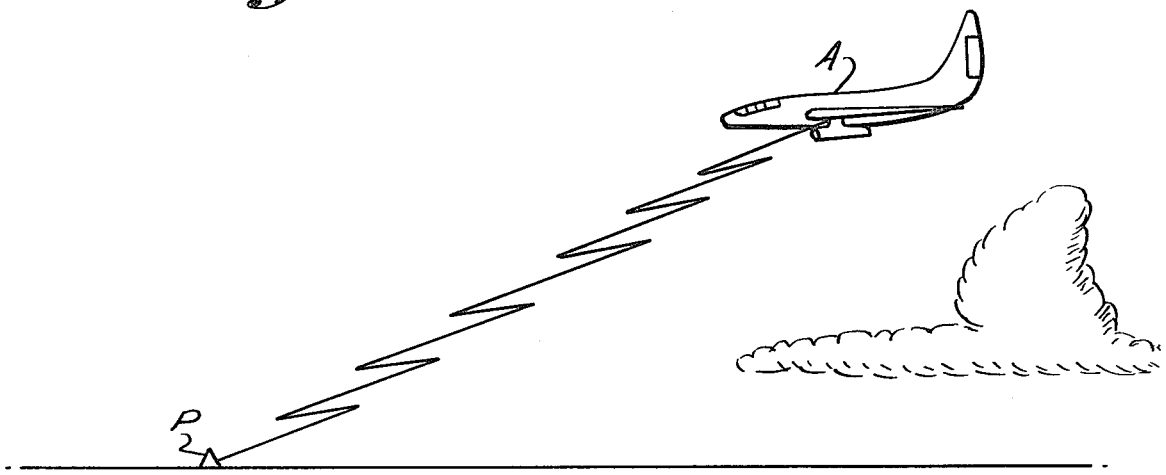
FIG. 1 shows an aircraft flying over a flat, level terrain.

In FIG. 1, an aircraft is shown flying over a flat and level terrain having no salient geographical features which an aircraft pilot could observe to determine his location. Areas having a uniform appearance from the air (and/or from the ground) are found in many parts of the world. Typical of such areas are deserts, plains, jungles, the tundra country of the sub-arctic, and the oceans. Such areas are hazardous to aircraft, particularly when pilots are unfamiliar with the area and local flying conditions. There is an ever-present danger of aircraft becoming lost and/or being unable to find a target location. This can result in aborted missions and losses of aircraft and personnel.

Figure 2:
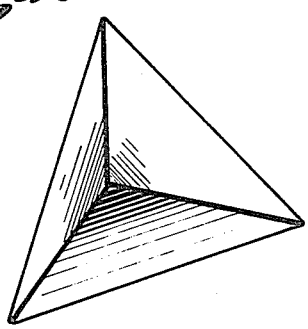
FIG. 2 shows a typical corner reflector.
Figure 3:
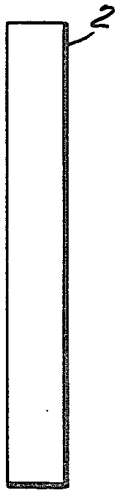
FIG. 3 shows a typical piece of radar reflective chaff.

FIG. 2 shows a passive reflective element known as a "corner" reflector. A radar beam which enters a corner reflections at any angle will be reflected back to the radar. FIG. 3 shows a piece of reflective "chaff." Both the corner reflector of FIG. 2 and the chaff of FIG. 3 may be dropped from aircraft or delivered by guided missile, artillery shells, etc. The corner reflectors are "nestable," that is they may be stacked compactly by nesting one within another. A considerable quantity of corner reflectors or chaff may be packed within a small missile or shell. The number of such reflectors used to mark a selected point can be so great that it is practically impossible for an enemy to find and destroy or remove them all in a short time.

In order to guide aircraft, a quantity of reflectors such as those shown in FIG. 2 or FIG. 3 may be placed at a selected point or points as at point P in FIG. 1. An aircraft may obtain a radar reflection from the reflectors and thus identify point P. The marked point can serve as a reference point for aircraft flights, for the control of guided missiles, or artillery fire, etc. For example, an aircraft which draws anti-aircraft fire from an area can call for artillery fire, missiles, or air strikes against the anti-aircraft installation by referencing its location to the marked point. A series of points may be marked to blaze a path across an area having no distinguishing geographic characteristics.

In combat situations there is danger that marking devices placed to guide friendly aircraft will be moved by the enemy to mislead friendly forces. Also, a large number of marked points which remained marked indefinitely could lead to confusion in many situations. Therefore, it is desired to use temporary marking means which will operate for a desired length of time only and then become deactivated.

The invention attains this objective by using radar reflective materials coated with a corrosive material which will destroy or otherwise deactivate the reflector material within a predetermined time. For example, reflectors can be made of aluminum foil and coated with a corrosive material such as alkali or acid salts which when exposed to the atmosphere will destroy the reflectors within a predetermined time. Some suitable corrosive materials are, for example, nitric acid, sulphuric acid, or other acid, or preferably a mixture of acids, for example, nitric acid mixed with a small proportion of sulphuric acid. Alkalis such as sodium and potassium hydroxide may be used. It is not essential that a reflector be destroyed completely. It may be deactivated by corroding the reflector surfaces to the extent that they cease to reflect radar signals to any significant extent. The corrosive material, preferably in crystal form, may be embedded in hygroscopic materials such as fibers, felt, felt-like materials, wool, or the like. Or, it may be impregnated into the metal.

Figure 4:
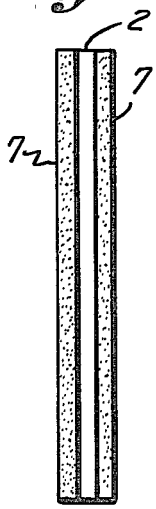
FIG. 4 shows a piece of chaff which is partially coated on each side.
Figure 5:
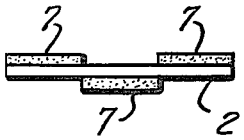
FIG. 5 shows an end view of the piece of chaff shown in FIG. 4.

FIG. 4 shows one side of a piece of chaff 2 of FIG. 3 partially coated with a corrosive material 7. FIG. 5 is an end view of chaff 2 showing coated areas 7 on both sides. Over a period of time, reflector 2 will be destroyed by corrosion from the corrosive areas. However, until the corrosion eats through the reflector material, the uncoated areas will reflect, regardless of which side is up. The coated areas 7 on one side of chaff 2 are matched by similar bare areas on the other side, as shown in FIGS. 4 and 5. Thus the length of time that the chaff continues to reflect is a function of the type and thickness of the metal used as well as of the corrosive material used. In the case of a corner reflector, a corrosive coating may be applied to the back of the corner reflector.

The timing of the destructive effect can also be adjusted by selecting the composition of the reflecting material, as by selecting a low-purity aluminum alloy such as one of not more than 99½% aluminum, which is more susceptible to corrosion than an alloy of higher purity.

The preceding description of radar reflective markers is by way of example only. The invention is not so limited but encompasses chemically self-destructive markers having a predetermined lifespan. Markers primarily designed for visual and sonar or other type sensing are contemplated. Numerous variations of the invention will suggest themselves to persons skilled in the art who have read applicant's disclosure. For example, the base material of a marker can be selected or constructed to self-destruct within a limited time when exposed. Obvious examples are materials which soon disintegrate when exposed to sunlight, rain, air, sea water, etc. Temporary self-destructive signs designed for marking areas such as military unit areas, ammunition dumps, etc., are contemplated. Such signs are necessary to military operations but are a security hazard because of enemy observation.

What is claimed is:

1. In a location marking system, the improvement comprising:

a radar marker, said marker being adapted to mark a selected location, said marker being adapted to contrast with said selected location so as to be readily detectable, chemically destructive means associated with said marker, said destructive means being adapted to be responsive to exposure to the environment to destroy the marking function of said marker within a predetermined time so that said marker ceases to mark said selected location after said predetermined time has elapsed, said marker comprising a plurality of reflective elements, said reflective elements being adapted to be placed by aircraft or missiles to mark said selected location, said destructive means comprising a destructive coating on each of said plurality of reflective elements, said coating being adapted to be activated when exposed to atmosphere, said coating being adapted to destroy the reflective properties of said reflective elements within said predetermined time after being activated, whereby signals are reflected from said marked location for a limited time only.

2. The apparatus of claim 1, wherein said destructive coating is adapted to destroy said reflective elements.

3. The apparatus of claim 1, wherein said reflective elements are partially coated on each side with said destructive coating, the partial coatings on each side being so positioned that a reflective surface is preserved on said reflective elements until said reflective surface is destroyed by said partial coating penetrating through said element.

4. The apparatus of claim 1, wherein said destructive coating is water activable.

5. The apparatus of claim 1, wherein said reflective elements are comprised of low purity aluminum, preferably of not more than 99½% aluminum, and said destructive coating is comprised of an alkali or alkali mixture.

6. The apparatus of claim 1, wherein said reflective elements are comprised of low purity aluminum, preferably of not more than 99½% aluminum, and said destructive coating is comprised of an acid or acid mixture.

7. The apparatus of claim 1, wherein the corrosive material is embedded in hygroscopic material, preferably fibers or felt.

8. The apparatus of claim 1, wherein said destructive means are impregnated into the metal.

* * * * *